US005173571A

United States Patent [19]

Montgomery

[11] Patent Number: 5,173,571

[45] Date of Patent: Dec. 22, 1992

[54] PROJECTILE GUIDE FOR TELESCOPED AMMUNITION

[76] Inventor: Donald N. Montgomery, 1615 Dorothy La., Newport Beach, Calif. 92660

[21] Appl. No.: 289,880

[22] Filed: Dec. 27, 1988

Related U.S. Application Data

[63] Continuation-in-part of Ser. No. 138,257, Dec. 28, 1987, abandoned.

[51] Int. Cl.[5] ..... 102 464; 102 443; F42B 5/045

[52] U.S. Cl. ..... 102/434

[58] Field of Search ..... 102/399, 430, 433, 434, 102/439, 443, 462–468

[56] References Cited

U.S. PATENT DOCUMENTS

| | | | |
|---|---|---|---|
| 274,378 | 3/1883 | Redmond | 102/499 |
| 3,476,048 | 11/1969 | Barr et al. | 102/399 |
| 3,482,516 | 12/1969 | Farmer et al. | 102/433 |
| 3,501,858 | 3/1970 | Hensley et al. . | |
| 3,528,187 | 9/1970 | Harrell . | |
| 3,575,112 | 4/1971 | Farmer . | |
| 3,847,081 | 11/1974 | Quinlan et al. | 102/433 |
| 3,848,530 | 11/1974 | Plumer . | |
| 4,197,801 | 4/1980 | Lafever et al. . | |
| 4,335,657 | 6/1982 | Bains | 102/434 |
| 4,404,263 | 9/1983 | Hodes et al. | 428/564 |
| 4,604,954 | 8/1986 | Clark et al. | 102/434 |
| 4,681,038 | 7/1987 | Washburn | 102/464 |
| 4,770,098 | 9/1988 | Stoner | 102/434 |

FOREIGN PATENT DOCUMENTS

| | | | |
|---|---|---|---|
| 675982 | 11/1964 | Italy | 102/463 |

*Primary Examiner*—Harold J. Tudor

*Attorney, Agent, or Firm*—Peter D. McDermott; Edward J. Radlo; Keith L. Zerschling

[57] ABSTRACT

A telescoped ammunition round comprises: a propellant charge having an axial cavity for supplying firing power for the ammunition round; a projectile housed within the axial cavity for being fired from a forward end of the ammunition round; a control tube means housed within the axial cavity for selectively covering an aft surface portion of the propellant charge axial cavity, the control tube means having a generally cylindrical axial bore substantially coaxial with the axial cavity, the projectile extending forward of the control tube means; coupling means for releasably securing the projectile to the control tube means; a control tube pistion having a generally cylindrical outer shape forming a sliding fit within the axial bore, positioned aft of the projectile; a booster charge within the axial bore, the control tube piston being forwardly movable in response to the firing of the booster charge and the projectile, in turn, being forwardly movable by forward movement of the control tube piston; a primer means in communication with the booster charge for actuating a firing sequence for the ammunition round; and projectile guide means for guiding the projectile during forward movement thereof from the axial cavity to a gun barrel upon firing the ammunition round, comprising a generally circular disk mounted in a forward position within the ammunition round substantially normal to the longitudinal axis thereof and concentric with the projectile, the disk comprising segmenting means for segmenting the disk into a plurality of generally triangular petals resiliently forwardly deflectable from the center of the disk to apply radially centering pressure upon the projectile during forward movement thereof.

22 Claims, 2 Drawing Sheets

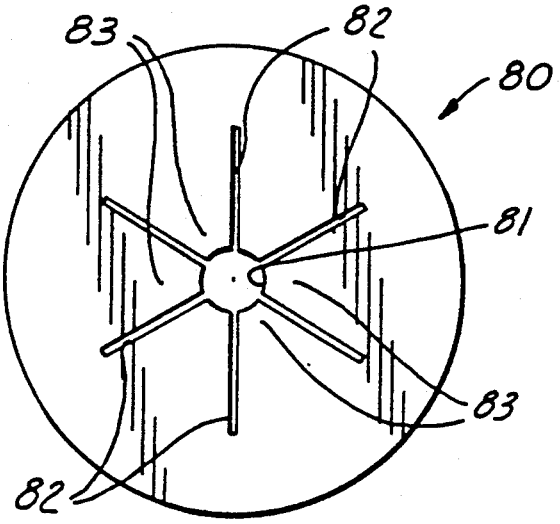
FIG.2
FIG.3
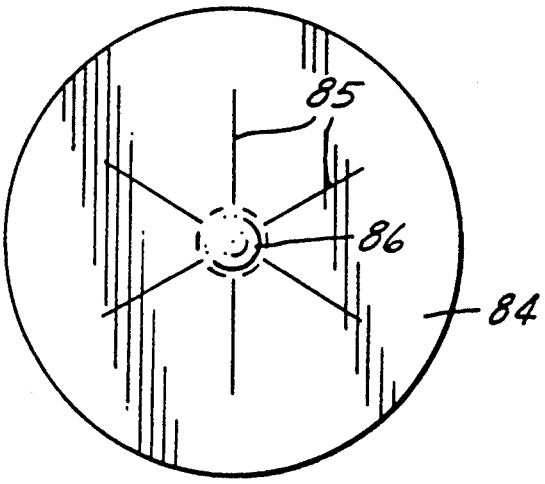
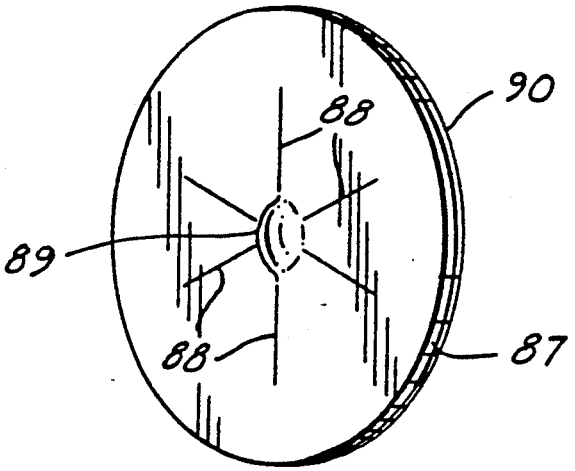
FIG.4

PROJECTILE GUIDE FOR TELESCOPED AMMUNITION

This application is a Continuation-in-Part of U.S. patent application Ser. No. 138,257 filed Dec. 28, 1987, now abandoned.

TECHNICAL FIELD

This invention relates to a structure for improving the ballistic performance of a telescoped ammunition round.

BACKGROUND ART

Telescoped ammunition typically includes a propellant charge having an axial bore or cavity, a projectile housed entirely within the axial cavity of the propellant charge and, optionally, a case around the propellant charge. When a telescoped round of ammunition is loaded into the chamber of a gun, the projectile, being housed in the cavity of the propellant charge, is not seated directly in the chamber/barrel of the gun, as is the projectile of a round of conventional ammunition when loaded in a gun chamber. When the telescoped round is fired, the projectile is forced forward into the barrel of the gun and at that time becomes seated in the barrel. More specifically, when the telescoped round is fired, a primer ignites a booster charge which causes forward motion of a piston located within the axial cavity of the propellant charge. The piston accelerates the projectile toward the gun barrel. The projectile moves at a relatively low velocity during this boost phase. Projectiles with short piston strokes and also long ogive projectiles, particularly projectiles having a center of gravity forward of the driving band, may be unstable during this boost phase and enter the gun barrel off-center (that is, not concentric with the gun barrel bore). This creates an uneven obturation and poor sealing within the gun barrel bore and may cause the projectile to ballot (oscillate side-to-side) down the gun barrel.

It has been known in the past to employ a so called "bore rider", that is a band, usually plastic, placed over the nose of the projectile. A bore rider, however, may get free of the projectile during firing of the round and enter the gun barrel ahead of the projectile. It may be destroyed in the barrel, in some cases leaving debris in the barrel, or be ejected at the forward end of the gun barrel. Such debris in a gun barrel or in the area of the gun can affect both safety and ammunition efficacy. In addition, in some instances bore riders do not adequately overcome the problem of projectile instability.

It is an object of the present invention to provide a telescoped ammunition round having improved projectile stability during firing. This and additional objects of the invention will be apparent from the following disclosure.

SUMMARY OF THE INVENTION

According to the present invention, a telescoped ammunition round comprises:

a propellant charge having an axial cavity for supplying firing power for the ammunition round; 7 a projectile housed within the axial cavity for being fired from a forward end of the ammunition round;

a control tube means housed within the axial cavity for selectively covering an aft surface portion of the propellant charge axial cavity, the control tube means having a generally cylindrical axial bore substantially coaxial with the axial cavity, the projectile extending forward of the control tube means;

coupling means for releasably securing the projectile to the control tube means;

a control tube piston having a generally cylindrical outer shape forming a sliding fit within the axial bore, positioned aft of the projectile;

a booster charge within the axial bore, the control tube piston being forwardly movable in response to the firing of the booster charge and the projectile, in turn, being forwardly movable by forward movement of the control tube piston;

a primer means in communication with the booster charge for actuating a firing seguence for the ammunition round; and Projectile guide means for guiding the projectile during forward movement thereof from the axial cavity to a gun barrel upon firing the ammunition round, comprising a generally circular disk mounted in a forward position within the ammunition round substantially normal to the longitudinal axis thereof and concentric with the projectile, the disk comprising segmenting means for segmenting the disk into a plurality of generally triangular petals resiliently forwardly deflectable from the center of the disk to apply radially centering pressure upon the projectile during forward movement thereof.

As discussed in greater detail below, the aforesaid projectile guide of the invention can be placed either about the projectile nose or just forward of the projectile nose. As the projectile is boosted by the control tube piston, the projectile nose enters the guide or passes further through it. If the projectile is off-center, one or more of the petals of the projectile guide will be deflected to a greater degree than the petals on the opposite side of the projectile. The petal(s) which are more deflected will provide a greater force against the adjacent surface of the projectile than will the opposed, less deflected petal(s). Thus, the net force applied to the projectile will be toward the longitudinal centerline of the ammunition round and gun barrel bore. In this way, the projectile guide of the invention is seen to have a centering and stabilizing effect on.the projectile during firing of the ammunition round. The projectile will be stabilized and either kept on the centerline or moved to the centerline to equalize the forces from the petals of the projectile guide means as the increasing projectile diameter travels through the guide bending the petals forward and outward. These and other features and advantages of the invention will be better understood from the following detailed description and the accompanying drawings.

BRIEF DESCRIPTION OF THE DRAWINGS

FIG. 2 is a plan view of the projectile guide means of the ammunition round of FIG. 1;

FIG. 3 is a plan view of a projectile guide means according to another embodiment of the invention; and FIG. 4 is a perspective view of the projectile guide means of FIG. 3 having a metal foil covering one surface thereof.

DETAILED DESCRIPTION OF PREFERRED EMBODIMENTS

Figure 1:
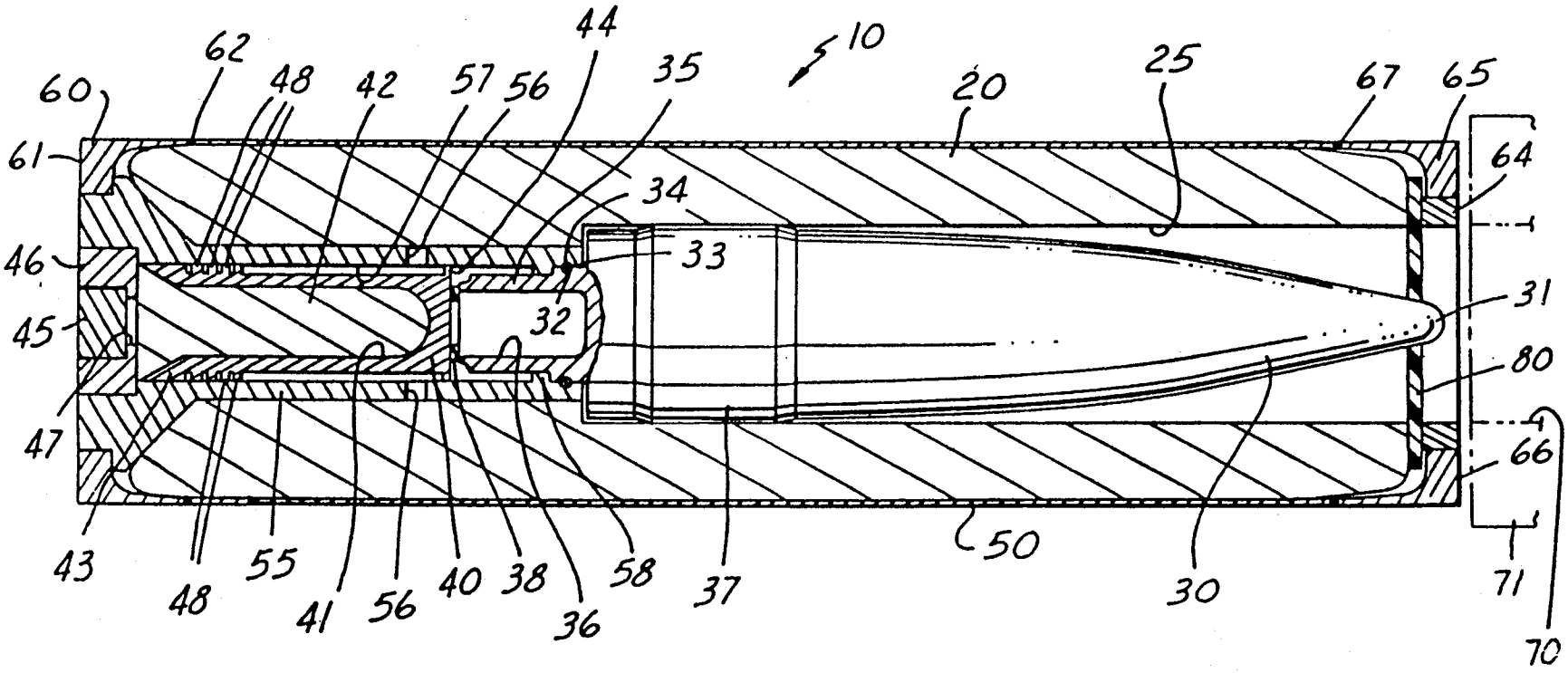
FIG. 1 is a section view of an ammunition round in accordance with a preferred embodiment of the invention.

According to certain preferred embodiments of the invention, in telescoped ammunition rounds comprising a propellant charge, projectile, control tube means, coupling means, control tube piston, booster charge, primer means and projectile guide means, as disclosed above, the control tube means includes at least a first firing opening providing access to the propellant charge from the axial bore so that temperature and pressure conditions within the axial bore adjacent the firing opening can cause firing of the propellant charge, each firing opening being positioned intermediate the axial ends of the control tube means. Such preferred embodiments further comprise:

sealing means for separating the axial bore into a forward portion and an aft portion, the sealing means providing a barrier conditionable between a first condition separating the primer means and booster charge from each firing opening and a second condition permitting communication between the propellant charge and the primer means and booster charge through each firing opening;

a generally tubular casing means surrounding the propellant charge and, preferably, being adapted to readily expand during firing of the ammunition round to sustain pressure created by the propellant charge without substantial permanent deformation; and first and second end cap means for providing a gas seal during firing of the ammunition round in a gun chamber, the first end cap means being seated at the forward end of the tubular casing means and having a central opening for passing the projectile means when the ammunition round is fired, and second end cap means being seated at the aft end of the tubular casing means and cooperating to close the aft end of the ammunition round. While the following discussion will focus on such preferred embodiments, it should be understood that the above recited additional features are not essential to the invention.

Referring now to FIGS. 1 and 2, an ammunition round 10 is seen to include a generally cylindrical main propellant charge 20 having a cylindrical axial cavity 25. Main propellant charge 20 is surrounded by generally tubular, cylindrical hollow outer case 50. Projectile 30 includes boom 35 extending rearwardly from the projectile and having a diameter substantially less than that of the main body of the projectile. Boom 35 has rearwardly opening recess 36 adapted to carry a trace or base bleed charge. Projectile 30 further comprises driving band 37. positioned aft of projectile 30 is a generally cylindrical piston 40 having a longitudinal axis aligned with the longitudinal axis of axial cavity 25. Between the forward face of piston 40 and the aft face of boom 35 is preferably an elastomeric ring 38 to keep these components firmly abutting, taking out substantially all play which could otherwise result due to manufacturing tolerances, etc. Piston 40 comprises rearwardly opening recess 41 which houses booster charge 42 for propelling piston 40 forward within control tube 55 which, in turn, causes corresponding forward motion of projectile 30 within axial cavity 25.

A primer charge 45 is housed within primer housing 46 positioned aft of booster charge 42. The primer charge is fired to cause firing of the booster charge. Thus, primer housing opening 47 is provided in the forward wall of primer housing 46. While in the embodiment shown in the drawings the piston is merely seated against the axially forward wall of the primer housing 46, it will be understood by those skilled in the art in view of the present disclosure that the primer means need not comprise such a housing.

Control tube 55 is a generally cylindrical, hollow sheath which surrounds primer charge housing 46, booster charge 42, piston 40 and a rearward portion of projectile 30, specifically, in the embodiment shown, boom 35. Control tube 55 is sized to fit snugly within the aft end of axial cavity 25 of main propellant charge 20 and has a multiplicity of circumferentially spaced firing openings 56 (two openings being shown in the cross-section of FIG. 1). According to embodiment of the invention alternative to those depicted in the drawings, the diameter of piston 40 can be such that it forms a sliding fit with the inner surface of control tube 55 along substantially its entire length. In this case, firing holes 56 would be adjacent to and closed by the outside surface of piston 40. This would provide a sealing means for separating the axial bore 57 of the control tube 55 into a forward portion and an aft portion. Such sealing means must be conditionable between a first condition in which the primer means and booster charge are separated from the firing openings and a second condition in which communication is permitted (through the firing openings) between the main propellant charge on one side of the firing openings and the combustion products of the primer means and booster charge on the other side. In the preferred embodiment of the invention shown in the drawings, such sealing means are provided by radially outwardly extending annular flange 43 extending cirCumferentially around the aft end of piston 40. Flange 43 has an outer diameter substantially equal to the diameter of axial bore 57 of control tube 55. As a result, piston 40 freely slides forward until flange 43 engages stop means. This engagement prevents piston 40 from following projectile 30 out of the ammunition round. It will be understood by those skilled in the art in view of the present disclosure, however, that alternative.embodiments of the invention may comprise a piston which is allowed to follow the projectile out of the ammunition round. According to other embodiments of the invention, the piston is integral with the projectile, rather than abutting the aft surface of boom 35 as in the embodiment of FIG. 1. In that case projectile 30 generally would provide no boom other than the piston which may, optionally, house a trace or base bleed charge in addition to the booster charge. Having a separate piston 40 and projectile 30 facilitates the manufacture and positioning of piston 40, thus minimizing the effect of volume variability within the ammunition round. When designing the transverse cross-section size of piston 40, it is desirable to keep it sufficiently small so there is a reduction in the piston velocity at ignition and a reduction in the potential for volume variability should some ignition delay occur.

Referring again to the preferred embodiment shown in the drawings, the aforesaid stop means comprises annular stop ring 58 provided as an integral, radially inwardly extending annular flange extending circumferentially around the forward end of control tube 55. This feature of an ammunition round according to preferred embodiments of the invention is disclosed in teachings known to the skilled of the art including, but not limited to, the teachings of U.S. Pat. No. 4,335,657, commonly assigned herewith, the teachings of which are hereby incorporated by reference.

Stop ring 58 limits forward movement of piston 40 when piston flange 43 moves forward and makes contact with it. According to this embodiment, the control tube piston does not exit axial cavity 25. This is advantageous, since the absence of significant solid debris exiting a gun muzzle can be of great importance, especially if the cartridge is to be used aboard aircraft or in other confined areas.

Further regarding the function of stop ring 58, it should be understood that the longitudinal axis of piston 40 is aligned with the longitudinal axis of control tube 55. The inner diameter of stop ring 58 is smaller than the diameter of the adjacent portion of control tube 55. Thus the inner portion of stop ring 58 extends radially into axial bore 57 of control tube 55. The outer diameter of piston 40 is sized to pass through stop ring 58 and, accordingly, the outer surface of piston 40 is spaced from the axial bore, i.e., from the interior surface of control tube 55. The abovedescribed circular flange 43 of piston 40, however, has an outer diameter substantially equal to the diameter of the interior surface of control tu.be 55. As a result, piston 40 can slide forward until flange 43 engages stop ring 58. At this point the piston is prevented from further forward motion.

Flange 43, in addition to serving to capture the piston within the ammunition round, serves as the sealing means of the ammunition round, for separating the firing holes 56 of control tube 55 from the primer and booster charges during the booster phase of the firing sequence. It will be appreciated, therefore, that the dimensions and positions of stop ring 58 and flange 43 must be such that when the piston is in its forwardmost position the flange 43 has passed forward of the firing openings 56, thereby allowing communication of hot combustion gases in the axial bore of the control tube through the firing holes to the main propellant charge. It will be appreciated that flange 43, during the booster phase of a firing, acts not only as a sealing means, but also as a travel guide for the piston within the control tube.

The rearmost portion of rear recess 41 within piston 40 has a bevelled surface, as shown in FIG. 1, so that the rearmost wall portion of piston 40 is somewhat thinner and will be forced by the gas pressures produced during combustion of the booster charge radially outward, thus sealing the outer wall of piston flange 43 against the inner wall control tube 55 and preventing forward. leakage of firing gases. Numerous suitable materials for manufacture of the piston will be apparent to those skilled in the art and include, for example, metals, high temperature plastics and the like.

In addition to rear piston flange 43, the piston is seen in the drawings to provide front guide means comprising flange 44 which stabilizes the piston within the axial bore of the control tube 55 prior to firing the ammunition round and for the initial travel of the piston forward during the firing sequence. Front guide flange 44 is sheared from piston 40 as the axially forward end of piston 40 travels past stop ring 58 of control tube 55. Control tube piston 40 further comprises, according to the preferred embodiment shown, sacrificial radial flanges 48. Near the end of the boost phase during the firing sequence, radial flanges 48 serve to slow the axially forward travel of control tube piston 40. Specifically, forward travel of the control tube piston is slowed as each of the radial flanges 48 contacts and is sheared off by stop ring 58. It will be within the skill of the art in view of the present disclosure to determine the number, position and thickness of radial flanges, if any, appropriate for a given ammunition round design. This will depend on such factors as, for example, the type and amount of booster charge used, the material of which the piston is fabricated, the size of the various components in the ammunition round, etc.

In the preferred embodiment shown, stop ring 58 is unitary with control tube 55. According to this embodiment the stop ring can be formed by well known machining techniques during the manufacture of the control tube. Alternative designs will be apparent to the skilled of the art in view of this disclosure and include, for example, the provision of a threaded stop ring. Specifically, the outer circular surface of the stop ring can be threaded to be received into a threaded recess at the axially forward end of the control tube.

It is preferred that there be some resistance to forward movement of the projectile during initial firing of the ammunition round. Releasably securing the projectile to the control tube provides a so called "shot start" for the projectile to improve the range and repeatability of projectile trajectory. Accordingly, coupling means are provided for releasably securing the projectile to the control tube. In the preferred embodiment shown in the drawings, projectile 30 is coupled to control tube 55 by means of a shearable ring. An inwardly facing circumferential groove 34 is provided in the control tube forward of stop ring 58. An outwardly facing circumferential groove 32 is provided in boom 35, grooves 32 and 34 being aligned with one another when the control tube and the projectile are assembled together in the ammunition round. Retainer ring 33 (for example, a 0.03 inch diameter nylon ring for a 25 mm round) is positioned in grooves 32 and 34 and is adapted to shear in response to forward movement of the projectile as a result of axial force applied to the projectile during the boost phase of the firing of the ammunition round. In this way, the grooves and retainer ring arrangement releasably secures the projectile to the control tube. The above described coupling of the projectile to the control tube, in addition to providing a shot start, provides the necessary structural support for the projectile during handling, storage, etc. Alternative means for coupling the projectile to the control tube and providing the shot start are known to the skilled of the art and include, for example, that shown in U.S. Pat. No. 4,335,657 to Bains, the disclosure which is hereby incorporated by reference. Another alternative is the provision of a friction fit between the projectile boom 35 and the stop ring 58. Additional alternative designs will be apparent to the skilled of the art in view of the present disclosure.

Control tube 55 launches and guides projectile 30 into the barrel of a gun. It contains the initial firing of primer charge 45 and booster charge 42 so that the start of the firing sequence occurs in a fixed volume, thus increasing the propulsive force applied to projectile 30. Specially, at a predetermined pressure, retainer ring 33 is sheared and there is forward movement of piston 40 within control tube 55. As a result of such forward movement of piston 40 there is forward movement of projectile 30. The volume containing the combustion gases from primer charge 45 and booster charge 42 is controlled by the action of sealing flange 43 preventing combustion gases passing forward between the outer wall of piston 40 and the inner wall of control tube 55.

After initial projectile acceleration, after piston 40 has moved sufficiently forward within axial bore 57 of the control tube 55, the ignition of main propellant charge 20 occurs through firing openings 56. Rear flange 43 of piston 40 is sufficiently short in an axial direction that firing openings 56 are clear of rear flange 43 when the forward face of rear flange 43 abuts stop ring 58. Thus, main propellant charge 20 fires as a function of the forward travel position of piston 40.. If desired, ignition of main charge 20 can be achieved by positioning an igniter charge at firing openings 56, for example by packing such igniter charge into the firing openings. Such igniter charge would provide a positive ignition of main propellant charge 20 in response to sufficient forward travel of projectile 30 and piston 40 within the axial cavity of the ammunition round. This feature can be incorporated into telescoped ammunition rounds according to preferred embodiments of the invention pursuant to teachings known to the skilled of the art including, but not being limited to, those of U.S. Pat. No. 4,197,801, commonly assigned herewith, the teachings of which are inCorporated herein by reference.

As noted above, main propellant charge 20 is bounded by a cylindrical hollow outer case 50 on the outside cylindrical surface. Optionally, an inner case on the inside cylindrical surface can be provided for a forward portion of axial cavity 25, that is, typically for that portion forward of the control tube. The aft end of the main propellant charge 20 and the forward end thereof optionally are sealed by an end component. Such end component would extend in the rear from the tubular outer case to the control tube. The front end sealing component would extend from the axial cavity to the outer tubular case. Alternative designs are known to the skilled of the art or will be apparent in view of the present disclosure. In the preferred embodiment shown in the drawings, the aft end of the ammunition round is seen to be closed by primer charge housing 46 in the center mating annularly with the rearmost portion of control tube 55 which, in turn, mates annularly with a rear end cap 60. A front end cap 65 is provided at the forward end of the ammunition round. During firing of the ammunition round the rear face 61 of rear end cap 60 and the forward face 66 of forward end cap 65 seat against the axially rearward and forward ends, respectively, of the ammunition chamber to provide a gas seal. The axially extending flange portions 62 and 67 of the rear end cap and forward end cap, respectively, also contact the chamber wall and maintain contact with the tubular case 50. Various designs are known to the skilled of the art for allowing radial expansion of the outer tubular case 50 with substantially no permanent deformation thereof. Substantial permanent deformation of the case might prevent rapid and easy removal of the case from a gun chamber following firing of the ammunition round. One such design calls for a split cartridge case, as disclosed in commonly assigned U.S. Pat. No. 4,604,954, the disclosure of which is incorporated herein by reference. A preferred design calls for a continuous tubular case which has been internally scored to facilitate resilient radial expansion during firing and contraction of the case thereafter. That is, when the ammunition round 10 is placed in the chamber of a gun, the scoring of the cartridge permits it to deflect to sustain the firing pressure without substantial permanent deformation. Since the case is not deformed, it is readily removable from the chamber after completion of the ballistic cycle. This feature is particularly applicable to use of an ammunition round in accordance with an embodiment of this invention in automatic multi-fire telescoped ammunition guns.

Projectile 30 is generally cylindrical with a tapered front tip 31 for improved aerodynamic performance. The rearward portion of projectile 30 carries driving band 37 which forms a sliding fit within axial cavity 25 of the ammunition round. Projectile 30 is further secured within the axial bore of the control tube by means of retainer ring 33, as described above.

The firing sequence of ammunition cartridge 10 includes the firing of primer charge 45 by such means as a firing pin or an electric spark so that heat and shock waves are transmitted to the booster charge within piston 40. The booster charge ignites to cause a pressure build-up aft of piston 40. At a predetermined pressure, there is forward movement of piston 40 within control tube 55. Forward movement of the piston causes forward movement of projectile 30. As projectile 30 leaves ammunition cartridge 10, it enters the bore 70 of gun barrel 71. Ideally, the projectile is stable and concentric with the gun barrel bore. The hot combustion gases caused by the firing of ammunition cartridge 10 propel the projectile through and out of the barrel. This staged sequence of ignition provides an energetic, fast and reproducable ignition of main propellant charge 20 controlled by the precise position of the projectile during the initial boost phase.

As noted above, if the projectile is not coaxially stable with the gun barrel bore upon entering the bore, it may not properly seal the main propellant gas pressure following main propellant charge ignition. Long ogive projectiles and projectiles with short piston strokes are especially susceptible to instability during the boost phase and, thus, to entering the gun barrel with an attitude which is not concentric with the gun barrel bore. This creates an uneven obturation and poor. sealing and may cause the projectile to ballot (oscillate side-to-side) down the gun barrel. According to the present invention, the telescoped ammunition round comprises a projectile guide 80 for guiding the projectile during forward movement thereof from the axial cavity of the ammunition round into the gun barrel bore during the firing sequence. As seen in FIGS. 1 and 2, the projectile guide comprises a generally circular disc mounted in a forward portion of the ammunition round substantially normal to the longitudinal axis thereof. The projectile guide is concentric with the projectile and may be mounted either forward of the projectile or about the projectile nose 31. The projectile guide is held at its periphery and in the preferred embodiment shown in FIGS. 1 and 2, the forward surface of the projectile guide seats against the aft surface of forward. end cap 65 and the aft surface of center ring 64. The aft surface of projectile guide 80 is seated against the forward end of propellant charge 20. Projectile guide 80 comprises a center aperture 81 and radial slots 82 forming generally triangular shaped petals 83. As the projectile is boosted by the control tube piston, the projectile passes through the guide. If the projectile is off-center, one or a few of the petals will provide a centering load to force the projectile nose toward the center to axially align it with the gun barrel bore. That is, the projectile will be moved to egualize the forces from the petals as the inqrease in projectile diameter travels through the projectile guide bending the petals outward and forward. The radial slots should extend sufficiently to readily accommodate the projectile, preferably extending over a radial dimension equal to the full diameter of the projectile plus the thickness of the projectile guide.

According to alternative embodiments of the invention, the projectile guide can be radially cut without removal of material, rather than removing material to form radial slots 82. Alternatively, the projectile guide may be provided with radial scores which do not cut entirely through the projectile guide. Radial scores are preferred where the projectile guide is to serve as a forward environmental seal for the ammunition round. In that case, the central aperture would be deleted such that the projectile guide was entirely imperforate. Optionally, in this case a starter dimple may be placed at the center of the projectile guide. Such dimple may be an area which is offset, preferably forwardly offset, or an area of reduced thickness to better ensure symmetrical opening of the petals of the projectile guide. A projectile guide according to this embodiment is shown in FIG. 3. Specifically, projectile guide 84 is shown to have radial scores 85 and centrally located starter dimple 86. It should be understood that where an environmental seal is provided at the forward end of the ammunition round, whether or not the projectile guide serves this function, an environmental seal also generally would be used at the aft end of the ammunition round.

Referring to FIG. 4, a projectile guide 87 according to a preferred embodiment of the invention is shown to comprise radial scores 88 and starter dimple 89. One surface of the projectile guide, preferably an axially forward surface thereof, is metallized. In the embodiment of FIG. 4 the metallized surface comprises metal foil 90, preferably aluminum foil or the like. The metal foil is drawn larger than scale relative the projectile guide for purposes of illustration. The metal foil can serve as a reflective medium for a sensor in a system designed to determine the proper orientation of an ammunition round by identifying the forward end of the round. According to an alternative embodiment, the metallized surface 90 comprises a sputtered metal coating.

Suitable materials for the projectile guide include, for example, materials which will be consumed by the firing of the ammunition round to reduce debris. Exemplary such materials include nitrocellulose, cellulose acetate, and the like. Alternatively, the projectile guide can be designed such that it survives the firing sequence, the petals either being deflected by the projectile but remaining in the ammunition round casing or being sheared off by the passing of the projectile. While the projectile guide, optionally, can be mounted externally, such as to the forward face of forward end cap 65, it is preferred that the projectile guide be designed and located so as not to affect the external dimensions of the ammunition round defined by the tubular casing 50 and the end caps 60, 65. It will be within the skill of the art in view of the present disclosure to manufacture the projectile guide according to commercially known methods. It will be understood that the dimensions of the petals and the number of petals into which the projectile guide is divided are matters of design choice which will be within the skill of the art in view of the present disclosure. Where the projectile guide is to serve as an environmental seal, it preferably would be coated with a suitable material, such as are known to the skilled of the art for such purposes.

While the projectile guide of the present invention should obviate the need for a bore rider, it is possible according to less preferred embodiments of the invention to employ both the projectile guide as described above and a bore rider. The bore rider may be mounted on the nose of the projectile forward of the projectile guide or may be designed to pass through the projectile guide.

Various modifications and variations will be apparent to those skilled in the various arts to which this invention pertains in view of the present disclosure. Such modifications and variations, including the particular size and configuration of the components, are properly considered to be within the scope of this invention as defined by the following claims.

I claim:

1. A telescoped ammunition round comprising:

a propellant charge having an axial cavity for supplying firing power for said ammunition round;

a generally tubular casing means surrounding said propellant charge;

a full caliber projectile housed within said axial cavity for being fired from a forward end of said ammunition round;

a control tube means housed within said axial cavity for selectively covering an aft surface portion of said propellant charge axial cavity, said control tube means having a generally cylindrical axial bore substantially coaxial with said axial cavity, said projectile extending from within said axial bore to forward of said control tube means;

coupling means for releasably securing said projectile to said control tube means;

a control tube piston having a generally cylindrical outer shape forming a sliding fit within said axial bore aft of said projectile;

a booster charge withins aid axial bore, said control tube piston being forwardly movable in response to the firing of said booster charge and said projectile being forwardly movable by forward movement of said control tube piston;

a primer means in communication with said booster charge for actuating a firing sequence for said ammunition round; and one-piece projectile guide means for guiding said projectile during forward movement of the projectile upon firing said booster charge, comprising a generally circular disk mounted in a forward position within said ammunition round and anchored to the tubular casing means substantially normal to the longitudinal axis of the projectile and concentric with said projectile, said disk comprising segmenting means for segmenting said disk into a plurality of generally triangular petals resiliently forwardly deflectable from the center of said disk to apply radially centering pressure upon said projectile during forward movement thereof during firing of said booster charge; whereby the disk remains anchored to the tubular casing means as the projectile is ejected from said ammunition round.

2. A telescoped ammunition round according to claim 1, wherein said projectile guide segmenting means comprises circumferentially spaced, radially extending scores in said disk.

3. The telescoped ammunition round according to claim 1, wherein said projectile guide segmenting means comprises circumferentially spaced, radially extending cuts through the material of said disk.

4. The telescoped ammunition round according to claim 1, wherein said projectile guide segmenting means comprises a guide hole at the center of said disk.

5. The telescoped ammunition round according to claim 1, wherein said projectile guide segmenting means comprises a guide dimple at the center of said disk.

6. The telescoped ammunition round according to claim 1, wherein said projectile guide is imperforate, said projectile guide segmenting means comprising equally circumferentially spaced scores extending radially from a guide dimple at the center of said disk to approximately one half the full radius of said disk.

7. The telescoped ammunition round according to claim 1, wherein said disk comprises material substantially consumable by the firing of said ammunition round.

8. The telescoped ammunition round according to claim 7, wherein said disk comprises material selected from the group consisting of nitrocellulose and cellulose acetate.

9. The telescoped ammunition round according to claim 1, wherein said projectile guide comprises a metallized surface.

10. The telescoped ammunition round according to claim 9, wherein said metallized surface comprises a metal foil substantially covering at least one side of said disk.

11. The telescoped ammunition round according to claim 10, wherein said metal foil consists of aluminum foil.

12. The telescoped ammunition round according to claim 9, wherein said metallized surface comprises a sputtered metal coating.

13. The telescoped ammunition round according to claim 1, further comprising a first and second environmental sealing means for sealing said ammunition round against environmental contaminants, said first environmental sealing means being positioned at a forward end of said tubular casing means and said second environmental sealing means being positioned at an aft end of said tubular casing means.

14. The telescoped ammunition round according to claim 13, wherein said projectile guide means is imperforate and said first environmental sealing means comprises said projectile guide means.

15. A telescoped ammunition round comprising:

a propellant charge having an axial cavity for supplying firing power for said ammunition round;

a full caliber projectile housed within said axial cavity for being fired from a foward end of said ammunition round;

a control tube means housed within said axial cavity for selectively covering an aft surface portion of said propellant charge axial cavity, said control tube means having a generally cylindrical axial bore substantially coaxial with said axial cavity, said projectile extending from within said axial bore to forward of said control tube means;

coupling means for releasably securing said projectile to said control tube means;

a control tube piston having a generally cylindrical outer shape forming a sliding fit within said axial bore aft of said projectile;

a booster charge within said axial bore, said control tube piston being forwardly movable in response to the firing of said booster charge and said projectile being forwardly movable by forward movement of said control tube piston;

a primer means in communication with said booster charge for actuating a firing sequence for said ammunition round; and said control tube means including at least a first firing opening providing access to said propellant charge from said axial bore so that temperature and pressure conditions within said axial bore can cause firing of said propellant charge;

sealing means for separating said axial bore into a forward portion and an aft portion, said sealing means providing a barrier conditionable between a first condition separating said booster charge from each said firing opening and a second condition permitting communication therebetween through each said firing opening;

a generally tubular casing means surrounding said propellant charge;

first and second end cap means for providing a gas seal during firing of said ammunition round in a gun chamber, said first end cap means being seated at the forward end of said tubular casing means and having a central opening for passing said projectile when said ammunition round is fired, and second end cap means being seated at the aft end of said tubular casing means; and one-piece projectile guide means for guiding said projectile during forward movement of the projectile upon firing said booster charge, comprising a generally circular disk mounted in a forward position within said ammunition round and anchored to the tubular casing means substantially normal to the longitudinal axis of the projectile and concentric with said projectile, said disk comprising segmenting means for segmenting said disk into a plurality of generally triangular petals resiliently forwardly deflectable from the center of said disk to apply radially centering pressure upon said projectile during forward movement thereof during firing of said booster charge; whereby the disk remains anchored to the tubular casing means as the projectile is ejected from said ammunition round.

16. The telescoped ammunition round according to claim 15, wherein said projectile guide means is positioned immediately rearward of said first end cap and immediately forward of said propellant charge.

17. The telescoped ammunition round according to claim 15, wherein said sealing means comprises a radially outwardly extending flange means at an aft end of said control tube piston for obstructing the flow of combustion gases between said control tube piston and said control tube means and for guiding said control tube piston within said control tube means.

18. The telescoped ammunition round according to claim 17, wherein said control tube means further comprises a stop means for limiting forward movement of said control tube piston, the diameter of said control tube piston forward of said flange means being sufficiently small to pass forward of said stop means and the diameter of said flange means being sufficiently large to engage and be unable to pass forward of said stop means.

19. The telescoped ammunition round according to claim 18, wherein said stop means comprises a generally annular, radially inwardly extending member.

20. The telescoped ammunition round according to claim 18, wherein said control tube piston further comprises at least one sacrificial flange extending radially outwardly from said control tube piston proximate and axially forward of said flange means, each said sacrificial flange being shearable from said control tube piston by said stop means during forward movement of said control tube piston.

21. The telescoped ammunition round according to claim 15, wherein said control tube piston further comprises front guide means at a forward end of said control tube piston for stabilizing said control tube piston prior to and during initial firing of the ammunition round.

22. The telescoped ammunition round according to claim 21, wherein said control tube means further comprises stop means for limiting forward movement of said control tube piston, and wherein said front guide means comprises an annular flange.integral with and extending radially outwardly from said forward end of said control tube piston, said annular flange being shearable by said stop means during forward movement of said control tube piston.

* * * * *